United States Patent [19]

Cyphelly

[11] Patent Number: 4,958,690

[45] Date of Patent: Sep. 25, 1990

[54] DRILLING DEVICE WITH HYDRAULIC PERCUSSION GENERATOR FOR EARTH DRILLING PURPOSES

[75] Inventor: Ivan J. Cyphelly, Cudrefin, Switzerland

[73] Assignee: Salzgitter Maschinenbau GmbH, Salzgitter, Fed. Rep. of Germany

[21] Appl. No.: 272,743

[22] PCT Filed: Feb. 5, 1988

[86] PCT No.: PCT/EP88/00085

§ 371 Date: Oct. 24, 1988

§ 102(e) Date: Oct. 24, 1988

[87] PCT Pub. No.: WO88/06673

PCT Pub. Date: Sep. 7, 1988

[30] Foreign Application Priority Data

Feb. 25, 1987 [CH] Switzerland ..... 707/87

[51] Int. Cl.[5] ..... E21B 1/00

[52] U.S. Cl. ..... 175/296; 175/234

[58] Field of Search ..... 175/93, 234, 235, 296, 175/297, 322, 417; 173/91

[56] References Cited

U.S. PATENT DOCUMENTS

| | | | |
|---|---|---|---|
| 3,379,261 | 4/1968 | Martini | 175/296 X |
| 3,387,671 | 6/1968 | Collier | 175/296 X |
| 3,416,613 | 12/1968 | Henderson | 175/296 X |
| 3,570,611 | 3/1971 | Riziuc | 175/296 |

*Primary Examiner*—William P. Neuder

*Attorney, Agent, or Firm*—Michael J. Striker

[57] ABSTRACT

A drilling device for drilling a borehole and comprising a drilling tool, a drill pipe extending into the borehole for conducting a flow of liquid thereinto for generating an oscillating percussion force applied to the drilling tool, a longitudinally movable impulse tube located below a lower end of the drill tube, a throttle located between a lower mouth of the drill tube and an upper mouth of the impulse tube for controlling a ration of flow portion of the liquid outside and inside the impulse tube in accordance with longitudinal position thereof, and a spring-loaded thrust valve for controlling the flow of liquid inside the tube.

10 Claims, 1 Drawing Sheet

DRILLING DEVICE WITH HYDRAULIC PERCUSSION GENERATOR FOR EARTH DRILLING PURPOSES

BACKGROUND OF THE INVENTION

This invention relates to a drilling device provided with a percussion generator, for earth drilling purposes, wherein the percussion generator is arranged to be actuated by a flow of liquid introduced into a borehole through a drill pipe, and wherein an oscillating percussion force exerted on a drilling tool attachable to the percussion generator is produced by means of a spring-loaded thrust valve which is in communication with the drill pipe and which controls the flow of liquid.

Devices of this general type are known for example from U.S. Pat. Nos. 2,388,741 and 3,018,834, and also from British patent specification No. 2776 (A.D. 1913). In these known devices the flow of flushing liquid flows through the thrust valve, which is held open by a spring arrangement with a high velocity and under high pressure, in order to act on a drilling tool which is fixed to a stem or piston of the thrust valve. As soon as the hydrodynamic forces of the flow of liquid against the thrust valve are greater than the opening force of the spring of the thrust valve, the thrust valve closes abruptly, so that, as a consequence of the high velocity and the high pressure of the flow of liquid supplied through the drill pipe, a pressure pulse is produced which acts against the stem or the piston of the thrust valve and is transmitted to the tool as a percussive movement. By virtue of this percussive movement the flow of liquid loses part of its energy, so that the spring of the thrust valve then opens the valve again and the process which produces the stroke can begin anew.

The known devices of this type have various disadvantages however which, until now, have prevented a trouble-free utilization of the known devices. Apart from the fact that in the known devices the flushing liquid which flows in must have a high speed and a high pressure, it has also been necessary that the thrust valve should have a sealing fit, in order to be able to guarantee the impulse pressure necessary for the movement stroke of the tool. Such a sealing fit of the thrust valve is susceptible to damage however since the flow of flushing liquid has a high dirt content. This can only be overcome by filtration, which results in increased expenditure. If the fit of the thrust valve is damaged, then the known devices can only function with reduced efficiency or, in the worst cases, can no longer function.

A further important disadvantage of the known devices is that the renewed opening of the thrust valve is not certain, since, only the movement stroke of the stem or of the piston of the thrust valve has an influence on the reduction of the liquid pressure acting on the thrust valve. With unfavorable speed or pressure conditions of the flow of flushing liquid and/or if there is dirt in the thrust valve which acts in a manner to block the thrust valve from fitting properly, one can have the result that the opening force of the thrust valve is not sufficiently great to open the valve again, so that the device is no longer functional.

Finally, the known devices also have the disadvantage that the various parameters, namely the velocity and the pressure of the flow of flushing liquid, the aperture of the thrust valve, the spring force of the thrust valve, and possibly the force of a restoring-spring of the thrust valve, etc., must be determined accurately in relation to each other in order to be able to maintain the operation of the devices within defined limits.

SUMMARY OF THE INVENTION

It is an object of the present invention to overcome the aforementioned disadvantages of the known devices and to create a device of the type first referred to above which uses as the energy carrier an unfiltered flow of liquid without causing functional damage, in other words without having to have an accurate fit and without sliding sealing parts in the thrust valve, and which also automatically ensures the cycles of successive closing and opening of the thrust valve.

This is achieved in accordance with the present invention by a device of the type first referred to above in which an impulse tube movable in the longitudinal direction is mounted at the lower end of the drill pipe, a flow distributing throttle is provided between a lower mouth of the drill pipe and an upper mouth of the impulse tube and by means of which, depending upon the axial position of the impulse tube, the ratio of the flow of liquid flowing in the borehole outside the impulse tube to the flow of liquid flowing within the impulse tube is controllable, the impulse tube is movable relative to the drill pipe in response to first spring means which biases the flow distributing throttle towards a position which reduces the liquid flow flowing in the borehole externally of the impulse tube, the lower end of the impulse tube is arranged to receive the drilling tool and contains the thrust valve which is biased towards an open position by second spring means, said thrust valve issues on the one hand into the interior of the impulse tube and on the other hand into the borehole outside the impulse tube, and the axial length of the impulse tube is substantially greater than the axial length of the thrust valve.

Since, in the device of the present invention, in similar fashion to a known so-called "hydraulic ram" or "water hammer", only the inertial force of a column of liquid, namely that within the impulse tube, is utilized, and since the function of the flow-interrupting thrust valve is separate from the function of actuating the tool, one needs no sliding sealing parts or fitting of valve parts. Moreover, the opening of the thrust valve after each successive percussive stroke is ensured by the flow distributing throttle. With an appropriate construction of the guide elements of the thrust valve, together with the aid of suitable spring means, even sliding guides can be avoided and eliminated.

The invention both as to its construction so to its method of operation, together with additional objects and advantages thereof, will be best understood from the following description of the preferred embodiments with reference to the accompanying drawings.

Figure 1:
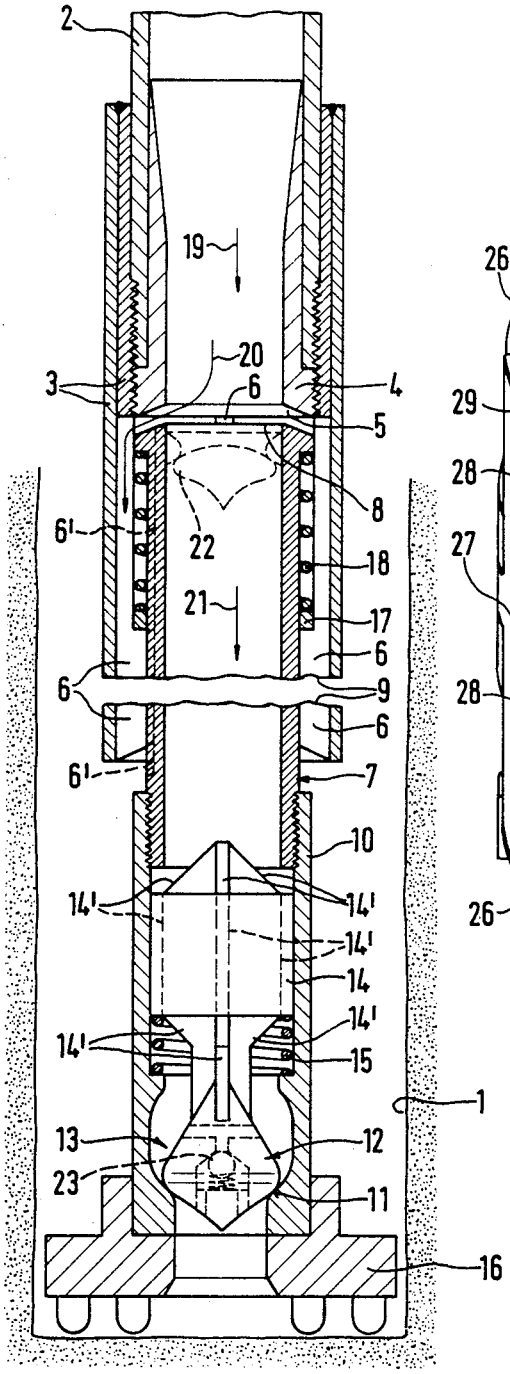
FIG. 1 is a longitudinal sectional view of a first embodiment of device according to the invention, construct a deep-well hammer drill; and, FIG. 2 is a perspective view of an alternative guide device for a valve body of the thrust valve of the device of FIG. 1, using spring elements.

Referring first to FIG. 1, there is shown a tubular drill pipe 2 within a borehole 1, but with only the lower end of the drill pipe being shown in FIG. 1. At this lower end of the drill pipe 2 a guide tube 3 is screwed into place. A further, inner tube 4 having an external screw thread is screwed to the internal thread of the guide tube 3 and defines a lower mouth 5 of the drill pipe 2. The guide tube 3 is provided with a total of four axially parallel guide splines 6 which are equispaced around the internal circumference of the tube. The guide splines 6 guide a coaxial impulse tube 7 for axial sliding movement. If the drill pipe 2 is driven rotationally, the splines 6 each engage inwardly in respective longitudinal grooves 6' in the impulse tube 7 in order to transfer the torque to the impulse tube 7. The impulse tube 7 has an upper mouth 8 which is positioned facing the lower mouth 5 of the inner tube 4 and consequently of the drill pipe 2, and forms, with the mouth 5, a flow distribution throttle, in a manner to be described hereinafter.

At the lower end of the impulse tube 7, the length of which as indicated by the broken lines 9 is substantially greater than is actually shown in the drawing, a valve seat sleeve 10 is screwed on to the impulse tube 7 as a constituent part of the tube. A valve seat 11 is provided at the lower end of the valve seat sleeve 10. A valve member 12 of a thrust valve indicated generally at 13, is guided for movement within the impulse tube 7 by a cylindrical sleeve 14 which has internal vanes 14' set in the form of a cross and fixed at their bottom end to the valve member. A spring 15 is arranged to act on the valve member 12. The spring 15 tends to lift the valve member 12 from the valve seat 11. It should be appreciated that the valve seat 11 and the valve member 12 in their closed position do not form a snug fit.

At the lower end of the valve seat sleeve 10, and thus at the lower end of the impulse tube 7, is secured a drilling tool 16 which is provided for deep-well hammer drilling purposes and which produces the actual borehole 1. The components which are movable with reference to the drill pipe 2, namely the impulse tube 7, the valve seat sleeve 10 together with the valve member 12 and the spring 15, and also the drilling tool 16, are biased towards the mouth 5 of the drill pipe 2 by a spring 18 which is seated against a support ring 17. The support ring 17 rests on radial steps in the splines 6.

In order to describe the method of operation of the device which is illustrated, an initial situation will first be described in which the thrust valve 13 is open and the impulse tube 7 is biased upwards by the force of the spring 18, and with flushing liquid flowing down through drill pipe 2 as indicated by the arrow 19. So long as the gap between the mouth 5 of the drill pipe 2 and the upper mouth 8 of the impulse tube 7 is large, a large part of the flushing liquid will flow, as indicated by the arrow 20, by virtue of lesser resistance, between the guide tube 3 and the impulse tube 7 and out into the borehole 1. As the closing movement progresses however the flow of liquid forced into the impulse tube 7 as indicated by arrow 21 increases, until the pressure drop force on the open thrust valve 13 caused by the increasing flow velocity in the impulse tube exceeds the bias force of the spring 15 of the thrust valve 13. Then, the thrust valve 13 is closed abruptly, and the aforementioned, axially relatively movable components 7, 10, 12, 15 and 16 are flung downwards by the inertia of the downwardly moving column of liquid contained in the impulse tube 7, since this "ram impact" exceeds the force of the restoring spring 18 many times over. Thus, the gap between the mouths 5 and 8 increases in size.

After the impact of the drilling tool 16 against the bottom of the borehole 1 the column of liquid in the impulse tube 7 loses its force. The liquid swings back within the impulse tube 7 through the gap between the mouths 5 and 8, in the direction of the arrow 20. After this the spring 15 can again open the thrust valve 1 3, and the spring 18 draws the axially relatively movable components 7,10,12,15 and 16 back again towards the mouth 5 of the drill pipe 2, which begins a new, similar cycle.

The frequency of these stroke movements is determined primarily by the velocity of the return stroke of the movable components 7,10,12,15 and 16, in other words by the force of the spring 18 in relation to the mass of the moving parts and to the stroke. This return movement is normally a comparatively slow process. The recoil of the liquid contained in the impulse tube 7 can however be used for the acceleration of the aforesaid return movement if, at the upper end of the impulse tube 7, in its mouth 8, there is provided a non-return valve 22 which is shown only schematically and in broken lines. The non-return valve 22 takes up the recoil of the column of liquid in the impulse tube 7 by closing, and consequently supplements the action of the spring 18. Since the non-return valve 22 remains closed for only a very short time, of the order of a few milliseconds, relief, i.e. opening, of the thrust valve 13 is not impaired by the closure of the non-return valve 22.

With large stroke movements, the time difference between the aforesaid "ram impact" of the column of liquid contained in the impulse tube 7 and the recoil of the drilling tool 16 from the bottom of the borehole 1 begins to be noticeable, which leads to a "double shock", since the pressure wave in the impulse tube 7 dies away rapidly. In order to avoid this undesirable phenomenon, one can incorporate additionally in the valve member 12 of the thrust valve 13 a pressure relief valve 23 which is illustrated schematically and in broken lines and which smooths out the pressure peaks which occur.

Figure 2:
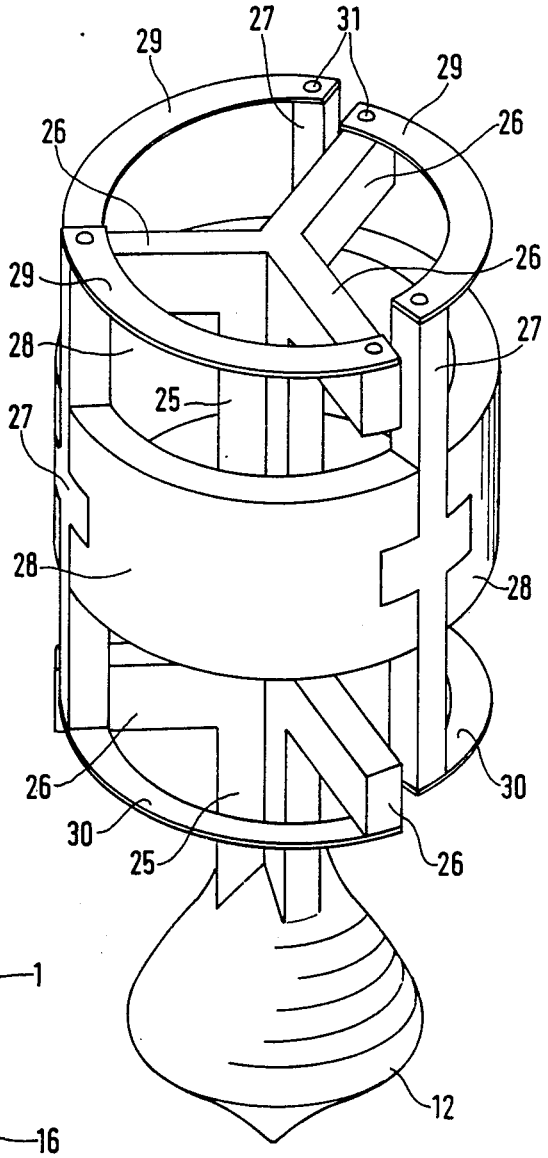

FIG. 2 is a perspective illustration of an alternative embodiment of guide and spring arrangement which can replace the sliding guidance and return action for the valve member 12 of the thrust valve 13 which is effected in the embodiment shown in FIG. 1 by the sleeve 14 and the spring 15. As can be seen from FIG. 2, in this variation, the valve member 12 of the thrust valve 13 of FIG. 1 is provided with an axial valve stem 25 which has axially spaced sets each of three radial arms 26 arranged in a common plane. The arms 26 are always positioned radially spaced from the valve seat sleeve 10 (FIG. 1). The present arrangement additionally comprises three guide rods 27 which, in a manner which is not shown, for example by means of screws, are secured to the inside of the valve seat sleeve 10 (FIG. 1). The upper and lower ends of the guide rods 27 are slightly above the axial ends of the arms 26 of the valve stem 25. Three segmental spacers 28 are provided between the three guide rods 27, in order to make possible the linking together of the illustrated structure. Both in the upper region and also in the lower region of the valve stem 25 and of the guide rods 27 the outer end of each arm 26 of the valve stem 25 is connected to one end of a guide rod 27 by a part-circular leaf spring 29 (at the top) and 30 (at the bottom). The connections can be effected by means of rivets 31 for example, or alternatively can be effected by welding at the appropriate positions. By means of these leaf springs 29 and 30, which each are S-shaped in the side elevation, the valve member 12 is at the same time both guided concentrically and also axially biased upwards in the opening direction, without the necessity for a sliding guide in the valve seat sleeve 10 (FIG. 1) or a restoring spring corresponding to the spring 15 of FIG. 1.

Since with the device of the present invention no fitting of the valve seat 11 and of the valve member 12 of the thrust valve needs to be provided, a trouble-free operation of the device both in respect of the closing movement of the thrust valve 13 and also in respect of its opening movement is therefore guaranteed, even if the flushing liquid has a very high dirt content. Since, moreover, the factors which determine the functioning of the device of the present invention are essentially dependent only on the column of liquid contained in the impulse tube 7, no special steps need to be taken in order to impart to the flushing liquid flow a particular velocity or a particular pressure. Finally, the device of the present invention requires comparatively few and simple component parts, so that its susceptibility to breakdown is extremely small.

While the invention has been illustrated and described with reference to specific embodiments of a drilling device for earth drilling purposes, it is not intended to be limited to the details shown, since various modifications and structural changes may be made without departing in any way from the spirit of the present invention.

Without further analysis, the foregoing will so fully reveal the gist of the pre sent invention that others can by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drilling device for earth-drilling a borehole and comprising:

a drilling tool;

a percussion generator for applying an oscillating percussion force to said drilling tool; and a drill pipe extending into the borehole for conducting a liquid flow thereinto for actuating said generator, said drill pipe having a lower mouth;

said percussion generator including:

a longitudinally movable impulse tube located beneath said drill pipe and having an upper end defining an upper mouth and a lower end, said drilling tool being mounted to said lower end of said impulse tube;

throttle means located between said upper and lower mouths for controlling a ratio of outside and inside portions of said liquid flow flowing on the one hand outside of said impulse tube directly into said borehole and on the other hand inside of said impulse tube in accordance with a longitudinal position of said impulse tube relative to said drill tube;

first spring means for biasing said impulse tube relative to said drill pipe into a position in which said outside portion of said liquid flow is reduced;

a thrust valve arranged at said lower end of said impulse tube for controlling the oscillating percussion force applied to said drilling tool, said thrust valve having a first portion extending into said lower end of said impulse tube and a second portion extending to the borehole outside of said impulse tube, said thrust valve having a first axial length and said impulse tube having a second axial length which is substantially greater than said first axial length of said valve; and second spring means for biasing said thrust valve to an open position thereof.

2. A drilling device according to claim 1 wherein said lower mouth of said drill pipe and said upper mouth of said impulse tube are coaxial and are located opposite to each other, said lower mouth having first peripheral edge means and said upper mouth having second peripheral edge means, said throttle means being formed by said first and second peripheral edge means being in axial alignment with each other and cooperating to form variable throttle means depending upon said longitudinal position of said impulse tube relative to said drill tube.

3. A drilling device according to claim 1 wherein said thrust valve comprises a valve seat and a valve member, said valve seat and said valve member being fitted without a snug fit.

4. A drilling device according to claim 1 wherein said thrust valve has a pressure side, said second spring means being arranged on the pressure side of said thrust valve inside of said impulse tube.

5. A drilling device according to claim 1 wherein said thrust valve comprises a valve seat and a valve member, and said second spring means is formed to guide said valve member without sliding guide means.

6. A drilling device for earth-drilling a borehole and comprising:

a drilling tool;

a percussion generator for applying an oscillating percussion force to said drilling tool; and a drill pipe extending into the borehole for conducting a liquid flow thereinto for actuating said generator, said drill pipe having a lower mouth;

said percussion generator including:

a longitudinally movable impulse tube located beneath said drill pipe and having an upper end defining an upper mouth and a lower end, said drilling tool being mounted to said lower end of said impulse tube;

throttle means located between said upper and lower mouths for controlling a ratio of portions of said liquid flow flowing outside and inside of said impulse tube in accordance with a longitudinal position of said impulse tube relative to said drill tube;

first spring means for biasing said impulse tube relative to said drill pipe into a position in which the outside portion of said liquid flow is reduced;

a thrust valve arranged at said lower end of said impulse tube for controlling the oscillating percussion force applied to said drilling tool, said thrust valve having a first portion extending into said lower end of said impulse tube and a second portion extending to the borehole outside of said impulse tube, said thrust valve having a first axial length and said impulse tube having a second axial length which is substantially greater than said first axial length of said valve;

second spring means for biasing said thrust valve to an open position thereof; and a guide tube fixed to said drill tube and having guide splines for guiding said impulse tube therein.

7. A drilling device for earth-drilling a borehole and comprising:

a drilling tool;

a percussion generator for applying an oscillating percussion force to said drilling tool; and a drill pipe extending into the borehole for conducting a liquid flow thereinto for actuating said generator, said drill pipe having a lower mouth;

said percussion generator including:

a longitudinally movable impulse tube located beneath said drill pipe and having an upper end defining an upper mouth and a lower end, said drilling tool being mounted to said lower end of said impulse tube;

throttle means located between said upper and lower mouths for controlling a ratio of portions of said liquid flow flowing outside and inside of said impulse tube in accordance with a longitudinal position of said impulse tube relative to said drill tube;

first spring means for biasing said impulse tube relative to said drill pipe into a position in which the outside portion of said liquid flow is reduced;

a thrust valve arranged at said lower end of said impulse tube for controlling the oscillating percussion force applied to said drilling tool, said thrust valve having a first portion extending into said lower end of said impulse tube and a second portion extending to the borehole outside of said impulse tube, said thrust valve having a first axial length and said impulse tube having a second axial length which is substantially greater than said first axial length of said valve; and second spring means for biasing said thrust valve to an open position thereof, said thrust valve comprising a valve seat and a valve member, and said second spring means is formed to guide said valve member without sliding guide means, said impulse tube having an inner surface and a plurality of guide rods secured to said inner surface, said valve member having a plurality of arms, and said second spring means including a plurality of leaf springs each having a first end fixedly connected to one of said arms and a second end fixedly connected to one of said guiding rods.

8. A drilling device according to claim 7 wherein said arms and said leaf springs are located in two axially spaced regions of said valve member, said guide rods extending between said two regions.

9. A drilling device for earth-drilling a borehole and comprising:

a drilling tool;

a percussion generator for applying an oscillating percussion force to said drilling tool; and a drill pipe extending into the borehole for conducting a liquid flow thereinto for actuating said generator, said drill pipe having a lower mouth;

said percussion generator including:

a longitudinally movable impulse tube located beneath said drill pipe and having an upper end defining an upper mouth and a lower end, said drilling tool being mounted to said lower end of said impulse tube;

throttle means located between said upper and lower mouths for controlling a ratio of portions of said liquid flow flowing outside and inside of said impulse tube in accordance with a longitudinal position of said impulse tube relative to said drill tube;

first spring means for biasing said impulse tube relative to said drill pipe into a position in which the outside portion of said liquid flow is reduced;

a thrust valve arranged at said lower end of said impulse tube for controlling the oscillating percussion force applied to said drilling tool, said thrust valve having a first portion extending into said lower end of said impulse tube and a second portion extending to the borehole outside of said impulse tube, said thrust valve having a first axial length and said impulse tube having a second axial length which is substantially greater than said first axial length of said valve;

second spring means for biasing said thrust valve to an open position thereof; and a non-return valve located in said upper mouth for increasing a force applied to said impulse tube by said first spring means by using the recoil of said liquid within said impulse tube which recoil is created upon closing of said thrust valve.

10. A drilling device for earth-drilling a borehole and comprising:

a drilling tool;

a percussion generator for applying an oscillating percussion force to said drilling tool; and a drill pipe extending into the borehole for conducting a liquid flow thereinto for actuating said generator, said drill pipe having a lower mouth;

said percussion including:

a longitudinally movable impulse tube located beneath said drill pipe and having an upper end defining an upper mouth and a lower end, said drilling tool being mounted to said lower end of said impulse tube;

throttle means located between said upper and lower mouths for controlling a ratio of portions of said liquid flow flowing outside and inside of said impulse tube in accordance with a longitudinal position of said impulse tube relative to said drill tube;

first spring means for biasing said impulse tube relative to said drill pipe into a position in which the outside portion of said liquid flow is reduced;

a thrust valve arranged at said lower end of said impulse tube for controlling the oscillating percussion force applied to said drilling tool, said thrust valve having a first portion extending into said lower end of said impulse tube and a second portion extending to the borehole outside of said impulse tube, said thrust valve having a first axial length and said impulse tube having a second axial length which is substantially greater than said first axial length of said valve;

second spring means for biasing said thrust valve to an open position thereof; and a pressure relief valve located in said thrust valve and being in connection with the borehole outside of said impulse tube for limiting a pressure shock occurring upon closing of said thrust valve.

* * * * *